US009187205B2

(12) United States Patent
Aksan et al.

(10) Patent No.: US 9,187,205 B2
(45) Date of Patent: Nov. 17, 2015

(54) TRAY WITH A BASE AND AN ANGLED LID

(71) Applicant: Georgia-Pacific Corrugated LLC, Atlanta, GA (US)

(72) Inventors: Yavuz Aksan, Suwanee, GA (US); Wayne P. Gasior, Duluth, GA (US); Ernest B. Widner, Gainesville, GA (US)

(73) Assignee: GEORGIA-PACIFIC CORRUGATED LLC, Atlanta, GA (US)

( * ) Notice: Subject to any disclaimer, the term of this patent is extended or adjusted under 35 U.S.C. 154(b) by 59 days.

(21) Appl. No.: 13/921,660

(22) Filed: Jun. 19, 2013

(65) Prior Publication Data

US 2013/0341383 A1 Dec. 26, 2013

Related U.S. Application Data

(60) Provisional application No. 61/661,825, filed on Jun. 20, 2012.

(51) Int. Cl.

| | |
|---|---|
| ***B65D 5/64*** | (2006.01) |
| ***B65D 5/32*** | (2006.01) |
| ***B65D 5/00*** | (2006.01) |

(52) U.S. Cl.

CPC ..... *B65D 5/324* (2013.01); *B65D 5/0015* (2013.01); *B65D 5/64* (2013.01); *B65D 2205/02* (2013.01)

(58) Field of Classification Search

CPC ..... B65D 5/64; B65D 5/68; B65D 5/0015; B65D 5/324; B65D 2205/02

USPC ..... 229/125.19, 125.29, 143, 148, 240, 229/243, 915, 162.1, 162.6

See application file for complete search history.

(56) References Cited

U.S. PATENT DOCUMENTS

| | | | | |
|---|---|---|---|---|
| 3,486,680 | A * | 12/1969 | Negus, Jr | 229/125.29 |
| 4,471,902 | A * | 9/1984 | Skaggs | 229/143 |
| 4,830,271 | A * | 5/1989 | Lau et al. | 229/125.19 |
| 5,390,847 | A * | 2/1995 | Young | 229/125.29 |
| 5,555,982 | A * | 9/1996 | Kuhn et al. | 229/240 |
| 6,354,487 | B1 * | 3/2002 | Muise, Jr. | 229/125.29 |
| 6,371,365 | B1 * | 4/2002 | Doucette et al. | 229/240 |
| 7,121,453 | B2 * | 10/2006 | Nass | 229/177 |
| 7,441,694 | B2 * | 10/2008 | Kenny | 229/915 |
| 2002/0079358 | A1 * | 6/2002 | Biddle | 229/125.19 |
| 2009/0277954 | A1 * | 11/2009 | De Paula et al. | 229/240 |

* cited by examiner

*Primary Examiner* — Gary Elkins
(74) *Attorney, Agent, or Firm* — William W. Letson

(57) ABSTRACT

The present application thus provides a tray for use with a number of products. The tray may include a base and a lid enclosing the base. The base may include a first wall and a second wall. The lid may include a first lid tab and a second lid tab such that the first lid tab of the lid is attached to an exterior of the first wall of the base and the second lid tab of the lid is attached to the exterior of the second wall of the base.

25 Claims, 3 Drawing Sheets

TRAY WITH A BASE AND AN ANGLED LID

TECHNICAL FIELD

The present application and the resultant patent relate generally to a tray and more particularly relate to a corrugated paperboard tray with a base and an angled lid that extends from corner to corner for reduced material requirements.

BACKGROUND OF THE INVENTION

Corrugated paperboard trays and cartons are in wide use to pack, ship, store, and display many different types of products. These cartons and trays must securely retain and protect the products therein during shipping and storage while providing easy access to the products for later display and/or removal. Moreover, existing supply chain requirements also must be met so as to ensure efficient production, transport, and use of the tray or carton across one or more industries or across one or more geographies.

There is thus a desire for an improved paperboard tray or carton. Such an improved tray or carton may accommodate a number of products of a predetermined size, shape, and configuration in a secure fashion but with less material and, hence, lower weight and overall lower material costs. Moreover, such an improved tray or carton should be easy to erect, easy to use, and economical to produce.

SUMMARY OF THE INVENTION

The present application and the resultant patent thus provide a tray for use with a number of products. The tray may include a base and a lid enclosing the base. The base may include a first wall and a second wall. The lid may include a first lid tab and a second lid tab such that the first lid tab of the lid is attached to an exterior of the first wall of the base and the second lid tab of the lid is attached to the exterior of the second wall of the base.

The present application and the resultant patent further provide a tray blank for erecting a tray. The tray blank may include a base blank with a first wall panel and a side wall panel and a lid blank with a first lid tab flap and a second lid tab flap. The lid blank may include an angled configuration from the first lid tab flap to the second lid tab flap.

The present application and the resultant patent further provide a tray for use with a number of products. The tray may include a base and a lid enclosing the base. The base may include a first wall and a second wall. The lid may include a first end, a second end, and an angled configuration from the first end to the second end.

The present application and the resultant patent further provide a tray for use with a number of products. The tray may include a base and a lid partially enclosing the base. The base may include a first wall and a second wall with a lid tab cutout. The lid may include a first end, a second end, and a lid tab sized to accommodate the lid tab cutout.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
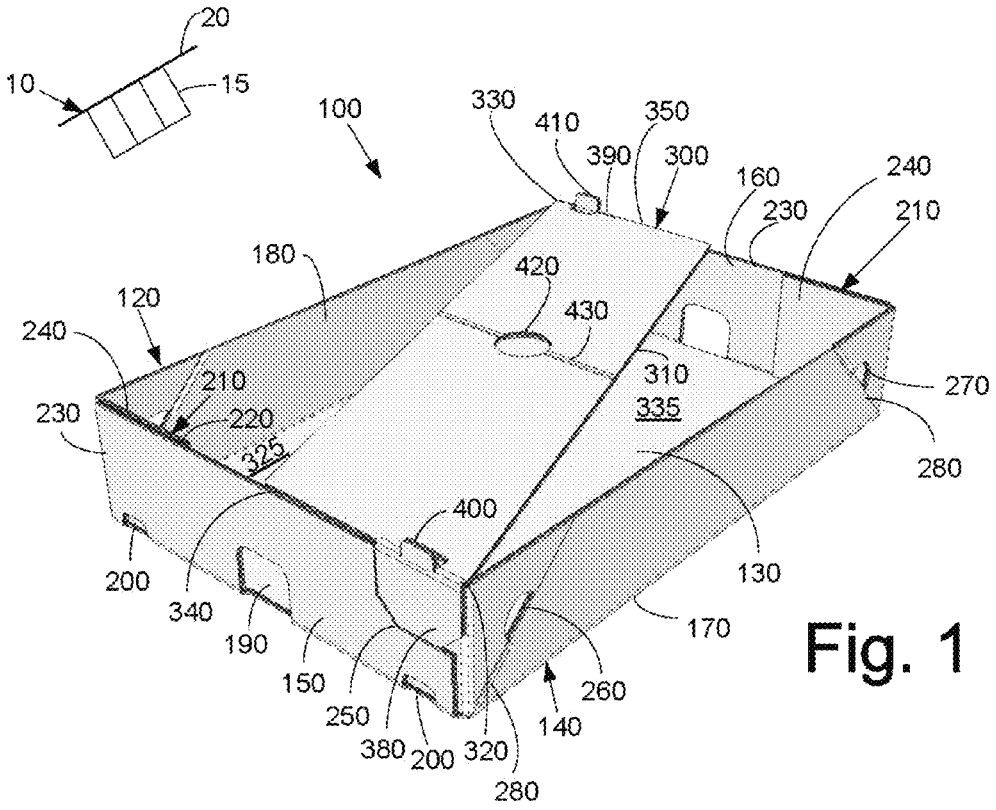
FIG. 1 is a perspective view of an example of a tray with an angled lid as may be described herein.

Referring now to the drawings, in which like numerals refer to like elements throughout the several views, FIG. 1 shows an example of a tray 100 as may be described herein. In this example, the tray 100 may be a stackable tray. Any suitable number of stackable trays may be stacked on top of each other as desired. The tray 100 may contain any number or types of products 10 therein. In this example, the products 10 may include a number of cups 15 joined along an extended lip 20. Such cups 15 may be in common use in the yogurt industry and the like. Any suitable type and number of the products 10, however, may be used herein.

In describing the tray 100, the terms "bottom," "top," "side," "end," and the like are used for purposes of relative orientation only and not as absolute positions. For example, any surface of the tray 100 may be used as the bottom or the top as oriented by a user. Similarly, the term "tray" is meant to encompass "cartons", "containers" and other types of enclosures.

The tray 100 may be made out of corrugated paper board stock 110 and the like. The corrugated paper board stock 110 may be recyclable. The corrugated paper board stock 110 may have a single wall construction and may be coated or uncoated. In this example, the corrugated board stock 110 may be a "B-flute" type corrugated board with about 49 flutes per linear foot. Other types of corrugated paper board stock may be used herein. For example, double wall constructions and the like may be used. Other types of substrates also may be used herein. The tray 100 may have any overall size. The size of the tray 100 may be standardized according to the intended industry or geography of use. Any type of graphics, messaging, and the like may be used on the tray 100.

The tray 100 may include a base 120. The base 120 may have any overall size and shape. The base 120 may include a bottom floor 130. The bottom floor 130 may be relatively flat or linear. The base 120 also may include a number of walls 140. Specifically, a first end wall 150, a second end wall 160, a first sidewall 170, and a second sidewall 180 are shown. (Generally described, the sidewalls 170, 180 have a longer length than the end walls 150, 160, but not necessarily. The terms may be used interchangeably herein.) Although the walls 140 are shown as being substantially straight or linear, curved walls and the like also may be used herein. Other types and other numbers of the walls 140 may be used herein. Other components and other configurations may be used herein.

Each of the end walls 150, 160 may have a ventilation hole 190 formed therein about a middle thereof. The ventilation holes 190 may have any suitable size, shape, or position. More than one ventilation hole 190 may be used on each of the end walls 150, 160. The ventilation hole 190 also may serve as a hand grip if desired. The ventilation holes 190 also may be positioned about the side walls 170, 180 or elsewhere. Each end wall 150, 160 also may include a pair of stacking tab slots 200. The stacking tab slots 200 may be positioned about the ends of the end walls 150, 160. The stacking tabs slots 200 may have any suitable size or shape. Any suitable number of the stacking tab slots 200 may be used. The stacking tab slots 200 may be configured to accommodate the stacking tabs as will be described in more detail below.

Each end wall 150, 160 may have a pair of reinforced ends 210. (Again, the end walls 150, 160 and the sidewalls 170, 180 are considered interchangeable herein.) Each of the reinforced ends 210 may be a double paneled member 220 with two distinct panels that may be joined together via an adhesive and the like. In this example, the double paneled member 220 may include an outer panel 230 and a pair of reinforcing flaps 240 on either side of the outer panel 230. Although FIG. 1 shows the reinforcing flaps 240 as extending only partially along the extent of the outer panel 230, the reinforcing flaps 240 may have any suitable size or shape. The outer panel 230 of one of the reinforced ends 210 on each end wall 150, 160 may include a lid tab cutout 250. The lid tab cutout 250 may have any suitable size or shape and may be configured to accommodate a lid tab as will be described in more detail below. More than one lid tab cutout 250 may be used herein. One or more of the reinforcing flaps 240 also may extend along the sidewalls 170, 180. Other components and other configurations may be used herein.

Each of the sidewalls 170, 180 may have one or more access holes positioned therein. For example, FIG. 1 shows a pair of access holes: a first access hole 260 and a second access hole 270. The access holes 260, 270 may take the form of a semi-circle and the like although the access holes 260, 270 may have any suitable size, shape, or configuration. Any number of the access holes 260, 270 may be used herein. The access holes 260, 270 may be positioned along the end walls 150, 160 as well. The access holes 260, 270 may be positioned about an angled tear line 280. The angled tear lines 280 may extend upwardly along the sidewalls 170, 180 at a diagonal from the bottom floor 130 at the intersection of the end walls 150, 160. The angled tear lines 280 may have differing configurations and may extend in other directions and lengths. The access holes 260, 270 and the angled tear lines 280 may or may not be used together and/or may be separated apart. Other components and other configurations may be used herein.

The base 120 also may be enclosed in part by a lid 300 to form the finished tray 100. The partial lid 300 may have an angled configuration 310 relative to the sidewalls 170, 180. The partial lid 300 may extend from a first corner 320 of the first end wall 150 to a second corner 330 of the second end wall 160 so as to define a first exposed area 325 and a second exposed area 335. The partial lid 300 also may extend about the sidewalls 170, 180. Moreover, the partial lid 300 need not extend only between opposite walls 140. Rather, the partial lid 300 may extend from an end wall 150, 160 to a sidewall 170, 180. The partial lid 300 may have any suitable size and shape to maintain the products 10 within the tray 100. The exposed areas 325, 335 likewise may vary in size and shape. Other configurations, such as straight, crisscross, and the like, also may be used herein. The partial lid 300 may have a first end 340 and a second end 350. The first end 340 may have a first lid tab 380 while the second end 350 may have a second lid tab 390. The lid tabs 380, 390 may be positioned and sized so as to be inserted within the lid tab cutouts 250 of the end walls 150, 160 or elsewhere. Likewise, multiple lid tabs may be used to accommodate the lid cutouts 250 in any or all of the walls 140, including adjacent walls 140, at any position along the walls 140.

The partial lid 300 also may have one or more stacking tabs. For example, FIG. 1 shows a pair of stacking tabs: a first stacking tab 400 positioned about the first lid tab 380 and a second stacking tab 410 positioned about the second lid tab 390. The stacking tabs 400, 410 may be sized to accommodate the stacking tab slots 200. Any number of the stacking tabs 400, 410 may be used herein. The partial lid 300 also may include a lid access hole 420 positioned about a lid tear line 430. The lid access hole 420 may be substantially circular in shape although any size or shape may be used herein. The lid tear line 430 may extend from one side of the partial lid 300 to the other. The path of the lid tear line 430 may vary. More than one lid access hole 420 and one lid tear line 430 may be used herein. The lid access hole 420 and the lid tear line 430 need not be used together and/or may be separated apart. Other components and other configurations may be used herein.

Figure 2:
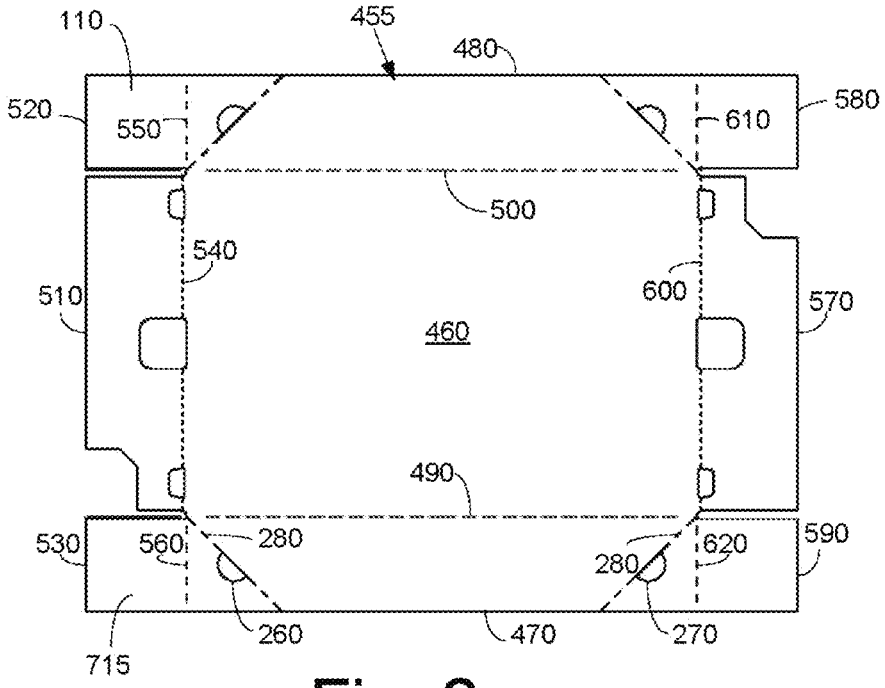
FIG. 2 is a plan view of an example of a blank that may be used to erect the base of the tray of FIG. 1.
Figure 3:
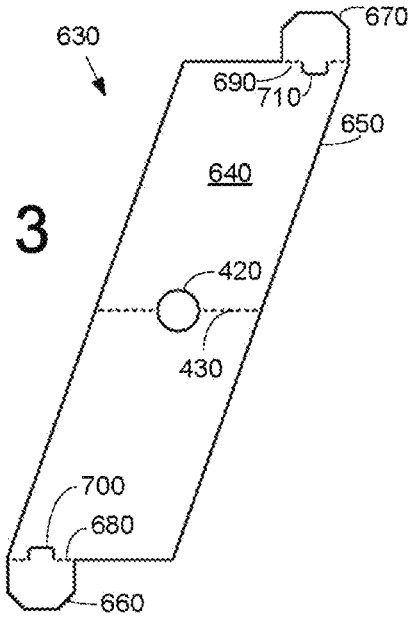
FIG. 3 is a plan view of an example of a blank that may be used to erect the lid of the tray of FIG. 1.

FIG. 2 and FIG. 3 show examples of a base blank and a lid blank that may be used for erecting the tray 100 such as that described above. As will be described in more detail below, the blanks may include a number of tear lines and a number of fold lines therein. It will be understood that the fold lines may be formed by crushing or scoring the corrugated paper board stock 110 along the line to be folded so as to facilitate bending and forming of the various panels and flaps herein. The terms tear lines and fold lines may be used interchangeably herein and include score lines, perforated lines, and the like. Other types of construction techniques also may be used herein. The blanks may have any suitable size.

As is shown in FIG. 2, the blanks may include a base blank 455 for erecting the base 120. The base blank 455 may be used to form the bottom floor 130, the end walls 150, 160 with the reinforcing flaps 240, and the sidewalls 170, 180. The bottom floor 130 may be formed from a bottom panel 460. The sidewalls 170, 180 may be formed from a first sidewall panel 470 and a second sidewall panel 480. The first sidewall panel 470 may be attached to the bottom panel 460 via a fold line 490 on one side while the second sidewall panel 480 may be attached via a fold line 500 on the other side. The sidewall panels 470, 480 may have the angled tear line 280 and the access holes 260, 270 formed therein.

The end walls 150, 160 may include the reinforced ends 210 with the double paneled member 220. The first end wall 150 thus may include a first end wall panel 510 and one or more reinforcing flaps. In this example, a first end first reinforcing flap 520 and a first end second reinforcing flap 530 are shown. The first end wall panel 510 may be attached to the bottom panel 460 via an end wall tear line 540. The end wall tear line 540 may have a tighter grouping of perforations so as to promote removal of the panel 510. The reinforcing flaps 520, 530 may be attached to the sidewall panels 470, 480 by one or more fold lines. In this example, a fold line 550 and a fold line 560 are shown. Likewise, the second end wall 160 may include a second end wall panel 570, a second end first reinforcing panel 580, and a second end second reinforcing panel 590. The panels 570, 580, 590 may be attached with an end wall tear line 600 and a number of fold lines 610, 620. The end wall panels 510, 570 have the stacking tab slots 200, the ventilation holes 190, and/or the lid tab cutouts 250 formed therein. As above, the configuration of the end wall panels 510, 570 and the sidewall panels 470, 480 may be reversed. Other components and other configurations may be used herein.

FIG. 3 shows an underside of a lid blank 630 for forming the partial lid 300 such as that described above. The lid blank 630 may include a lid panel 640 with an angled configuration 650 or other configuration. A first lid tab flap 660 and a second lid tab flap 670 may extend from opposite corners on either end of the lid panel 640. The lid flap panels 660, 670 may be attached by a pair of fold lines 680, 690. A pair of cut lines 700, 710 may be used to form the stacking tabs 400, 410. The lid panel 640 also may include a lid tear line 430 and/or a lid access hole 420 formed therein. Other components and other configurations also may be used herein.

In order to erect the tray 100 from the blanks 455, 630, the first and second sidewall panels 470, 480 of the base blank 455 may be folded about the fold lines 490, 500. The first and second end reinforcing flap panels 520, 530, 580, 590 may be folded inward along the fold lines 550, 560, 610, 620. The end wall panels 510, 570 may be folded upward along the tear lines 540, 600. The end wall panels 510, 570 may be attached to the reinforcing flap panels 520, 530, 580, 590 via a conventional adhesive or other types of joinder means. The order of these assembly steps may vary. Other or fewer assembly steps also may be used herein.

In use, the products 10 may be positioned within the base 120 of the tray 100. The partial lid 300 may be attached such that the lid tabs 380, 390 may be attached within the lid tab cutout 250 of the end walls 150, 160 via an adhesive and the like to an exterior 715 of the reinforcing flap 240. The lid tabs 380, 390 thus extend over the walls 140 of the base 120. Although the partial lid 300 does not completely enclose the base 120, the angled configuration 310 or other configuration maintains the products 10 securely therein. Moreover, the products 10 may be visible in part through the exposed areas 325, 335. The partial lid 300 may be in close proximity to the products 10 therein. The use of the angled configuration 310 or other configuration thus provide a partial lid 300 that uses less material while safely maintaining the products 10 therein. The trays 100 may be stacked along the stacking tabs 400, 410 and the stacking tab slots 200. Any number of the trays 100 may be stacked herein.

The partial lid 300 may be removed by accessing the lid access hole 420 and tearing along the lid tear lines 430. The fold lines 680, 690 also may be torn to remove the partial lid 300. Further, the lid tab flaps 660, 670 may be torn from the end walls 150, 160. If desired, the end walls 150, 160 also may be torn from the sidewalls 170, 180. The end walls 150, 160 may be removed by grasping the access holes 260, 270 along the sidewalls 170, 180 and tearing the end walls 150, 160 along the angled tear line 280 and the end wall tear lines 540, 600. The products 10 may then be displayed in the base 120 or removed therefrom. The tray 100 may have other purposes and uses in addition to those described herein. The tray 100 may have varying sizes depending upon the nature of the products 10 therein.

Figure 4:
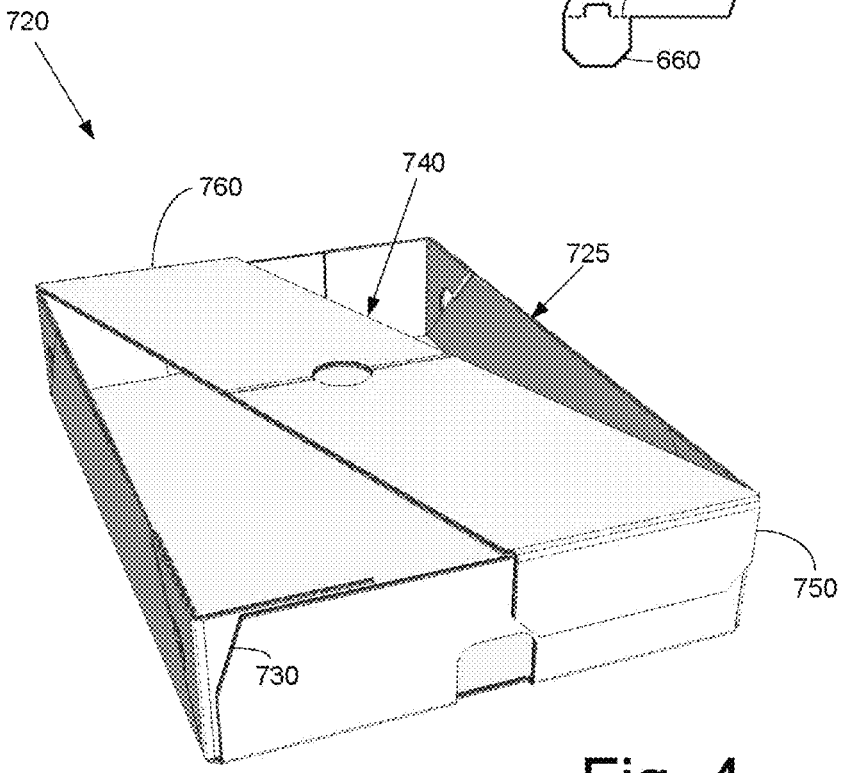
FIG. 4 is a perspective view of an alternative embodiment of a tray as may be described herein.
Figure 5:
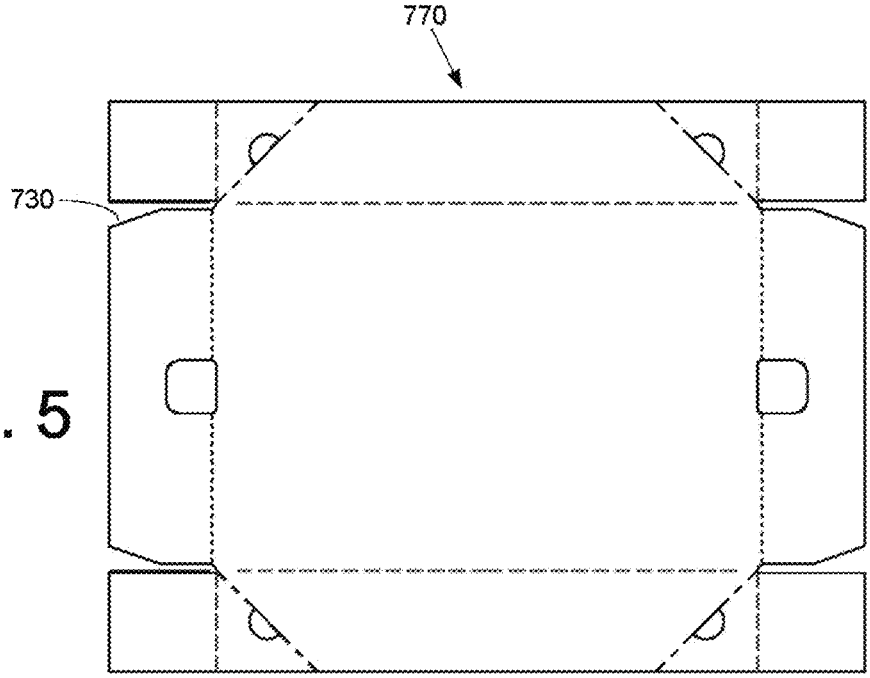
FIG. 5 is a plan view of an example of a blank that may be used to erect the base of the tray of FIG. 4.
Figure 6:
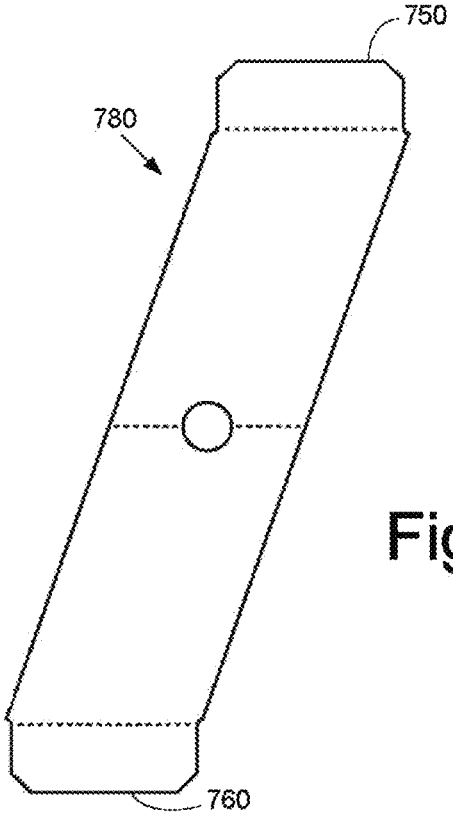
FIG. 6 is a plan view of an example of a blank that may be used to erect the lid of the tray of FIG. 4.

FIG. 4 shows a further embodiment of a tray 720 as may be described herein. The tray 720 may be largely similar to that described above with the exception of the end walls 150, 160 of a base 725. In this example, the end walls 150, 160 may not include lid tab cutouts 250. Rather, the end walls 150, 160 simply may include a pair of tapered edge 730. Likewise, the tray 720 also may include a lid 740. The lid 740 may be similar to that described above. A first lid tab 750 and a second lid tab 760 may extend along both ends of the lid 740. In this example, the lid tabs 750, 760 may cover about half of the extent of the end walls 150, 160 although other suitable sizes may be used herein. Moreover, the lid tabs 750 may extend down the end walls 150 or elsewhere to any extent including the down to the bottom floor 130. Cutouts and the like may accommodate the ventilation holes 190 and/or other structures. Likewise, FIGS. 5 and 6 show a base blank 770 and a lid blank 780 of a similar design. The base 725 and the lid 740 may be erected and used in a manner similar to that described above. Other components and other configurations may be used herein.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A tray for use with a number of products, comprising:
a base having a first width;
the base comprising a first wall and a second wall; and
a lid enclosing the base in part, such that a first portion of the base is exposed on a first side of the lid and a second portion of the base is exposed on a second side of the lid, the lid having a second width of about half the first width;
the lid comprising a first lid tab flap and a second lid tab flap such that the first lid tab flap of the lid is attached to an exterior of a first corner of the first wall of the base and the second lid tab flap of the lid is attached to the exterior of a second corner of the second wall of the base, wherein the second corner is opposite and diagonally across from the first corner;
the lid comprising an angled configuration from the first corner to the second corner.

2. The tray of claim 1, wherein the first wall and the second wall of the base comprise a lid tab cutout sized to accommodate the first lid tab and the second lid tab.

3. The tray of claim 2, wherein the first wall and the second wall of the base comprise one or more reinforced ends.

4. The tray of claim 3, wherein the one or more reinforced ends comprise a double paneled member.

5. The tray of claim 3, wherein the one or more reinforced ends comprise an outer panel and a reinforcing flap.

6. The tray of claim 5, wherein the lid tab cutout is positioned within the outer panel.

7. The tray of claim 5, wherein the first lid tab and the second lid tab are attached to the exterior of the reinforcing flaps.

8. The tray of claim 1, wherein the first wall comprises a first end wall and wherein the second wall comprises a second end wall.

9. The tray of claim 1, further comprising a corrugated paper board.

10. The tray of claim 1, wherein the first wall and the second wall of the base comprise one or more ventilation holes.

11. The tray of claim 1, wherein the first wall and the second wall of the base comprise a plurality of stacking tab slots.

12. The tray of claim 1, wherein the lid comprises one or more stacking tabs.

13. The tray of claim 1, wherein the first wall and the second wall of the base each comprise a wall tear line.

14. The tray of claim 1, wherein the first wall and the second wall of the base each comprise one or more access holes.

15. The tray of claim 1, wherein the first wall and the second wall of the base each comprise an angled tear line.

16. The tray of claim 1, wherein the lid comprises one or more lid access holes.

17. The tray of claim 1, wherein the lid comprises a lid tear line.

18. The tray of claim 1, wherein:
the first portion and the second portion of the base are substantially triangular;
and the first lid tab is attached at the first corner of the base partially formed by the first wall, and at the second corner opposite the first corner of the base partially formed by the second wall.

19. A pair of blanks for erecting a tray, comprising:

a base blank having a first width;

the base blank comprising a first wall panel and a second wall panel;

a partial lid blank having a second width of about half the first width;

the partial lid blank comprising a first lid tab flap and a second lid tab flap; and the partial lid blank comprising an angled configuration from the first lid tab flap to the second lid tab flap, wherein the first lid tab flap and the second lid tap flap are on opposite corners of the partial lid blank, and the partial lid blank is angled between the opposite corners.

20. The blanks of claim 19, wherein the first wall panel and the second wall panel each comprise an access hole.

21. The blanks of claim 19, wherein the first wall panel and the second wall panel each comprise an angled tear line.

22. The blanks of claim 19, wherein the first wall panel and the second wall panel each comprise a lid tab cutout.

23. The blanks of claim 22, wherein the lid tab cutouts of the first wall panel and the second wall panel are sized to accommodate the first lid tab flap and the second lid tab flap.

24. A tray for use with a number of products, comprising:

a base having a first width;

the base comprising a first wall and a second wall; and a separately formed lid enclosing the base in part, such that a first portion of the base is exposed on a first side of the lid and a second portion of the base is exposed on a second side of the lid, wherein the lid has a second width of about half the first width;

the lid comprising a first end and a second end, wherein the first end is configured to attach to a first corner of the base, and the second end is configured to attach to a second corner of the base opposite and across from the first corner; and the lid comprising an angled configuration from the first end to the second end.

25. A tray for use with a number of products, comprising:

a base having a first width;

the base comprising a first wall and a second wall;

the first wall and the second wall each comprising a lid tab cutout; and a lid partially enclosing the base, such that a first triangular portion of the base is exposed on a first side of the lid and a second triangular portion of the base is exposed on a second side of the lid, wherein the lid has a second width of about half the first width;

the lid comprising a first end at a first corner and a second end at a second corner that is opposite and diagonally across from the first corner; and the first end and the second end each comprising a lid tab sized to accommodate the lid tab cutouts.

* * * * *